United States Patent [19]

Birnbaum

[11] 3,983,824

[45] Oct. 5, 1976

[54] KNOCKED DOWN CONSOLE TABLE

[75] Inventor: Leonard V. Birnbaum, Highland Park, Ill.

[73] Assignee: Burwood Products Company, Chicago, Ill.

[22] Filed: Oct. 23, 1975

[21] Appl. No.: 625,257

[52] U.S. Cl. ..... 108/152; 108/153

[51] Int. Cl.[2] ..... A47B 5/00

[58] Field of Search ..... 108/159, 157, 153, 42, 108/152; 248/188; 211/90, 88; 312/204

[56] References Cited

UNITED STATES PATENTS

| | | | |
|---|---|---|---|
| 1,757,398 | 5/1930 | Squires | 108/42 |
| 2,582,557 | 1/1952 | Palkman | 108/42 |
| 2,911,108 | 11/1959 | Nield | 108/152 |

*Primary Examiner*—Ramon S. Britts
*Assistant Examiner*—Darrell Marquette
*Attorney, Agent, or Firm*—Michael G. Berkman

[57] ABSTRACT

A sectional, knocked down, console table of molded plastic parts, and adapted for attachment to a wall to hang thereon. The table consists of a one-piece top or shelf with a separate apron or skirt depending downwardly from the forwardly presented edge. The skirt comprises a center section and a pair of separate laterally spaced side sections which interlock with the center section and serve as lateral support brackets for the composite assembled structure. The various structural components are secured to one another mechanically by means including channel slots with cooperating friction flanges or ribs; combination post, tab, and screw assemblies; and keying interlocks; whereby the table may be shipped knocked down as a substantially flat, space-saving package, and may then be quickly, easily, and permanently assembled in seconds, using two simple screws.

2 Claims, 7 Drawing Figures

KNOCKED DOWN CONSOLE TABLE

This invention relates to an improved console table of molded rigid plastic. More particularly, the invention is directed to a console table of molded plastic parts which is fabricated as a sectional article, which may be conveniently shipped in a knocked down form, and which may, thereafter, be simply and quickly assembled without the use of special tools. In the preferred embodiment the console table is of the type which is adapted for attachment to a wall so that, functionally, the table constitutes a shelf with a depending, decorative facing skirt.

Tables or shelves of the general type to which the present invention is directed are known in the prior art. The prior art structures also include tables consisting of several discrete structural components which, after fabrication, may be secured to one another to form a substantially unitary structure. However, each of the prior art tables of the class identified has one or more serious deficiencies or shortcomings which have impaired general acceptance. In some cases the manner of interconnecting the components has been unreliable and the parts have failed to remain secured. In other cases the mode of interconnecting the component elements has been unduly complex. In still other arrangements the particular physical form of component parts has required shipping packages which are unduly cumbersome and space demanding. Is is, therefore, the aim of the present invention to obviate the shortcomings of the prior art and to provide a simple, utilitarian, yet aesthetically pleasing console table of the knocked down type which may be packaged in a relatively flat container of minimal volume for cost savings in shipment, and which may readily be assembled without the use of special tools. The table of the invention constitutes a unitary structure in which structural security and reliability are achieved without sacrifice of aesthetic values.

It is an important feature of the table of the invention that the table top is of a single panel construction whereas the decorative depending skirt constitutes a plurality of separate elements so that in its knocked-down state the table may be packed in a substantially flat shipping carton of minimal volume demand.

An additional feature of the invention is that there is provided a mechanical interlock arrangement through which the several separate components of the depending skirt are cooperatively keyed to one another and secured in place.

Yet another feature of the invention is the provision of positive mechanical fasteners which preclude inadvertent separation of the depending skirt from the table top. Other and further objects, advantages and features of the invention will become apparent from a reading of the following specification taken in conjunction with the drawing in which.

Figure 1:
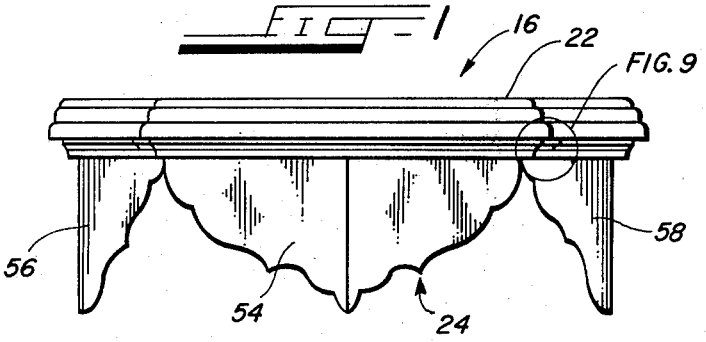
FIG. 1 is a front elevational view of the console table of the invention, in its assembled condition.
Figure 2:
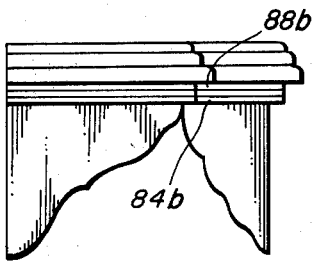
FIG. 2 is an end elevational view.

Referring now to the drawing, and particularly to FIGS. 1, 3, 5 and 6, for purposes of disclosure, the invention is shown embodied as a wall mountable console 16 consisting of a plurality of separate structural elements including a top or shelf 20 of generally tray-like construction including a substantially planar article supporting top panel 22 and a skirt 24. The top 20 is integrally formed with an edge rail 26 depending downwardly therefrom. Also integrally formed with the top panel 22, on its underside, are a plurality of linearly arranged, pairs of opposed parallel wall sections 28, 30 and 32, each pair defining open channel-like slots 34, 36 and 38. The panel 22 also carries on its underside a pair of laterally spaced posts **40*a* and 40*b* each integrally formed with the panel 22 and extending normally thereof. In the preferred embodiment of the invention depicted, the posts are end-bored axially and internally threaded 42*a* and 42*b*. Also, in the specific example of the invention illustrated, the back member 46 of the rail 26 of the top 20 is formed with a pair of laterally spaced through openings 50*a* and 50*b* having enlarged lower portions to receive the head of a nail or screw therethrough. The enlarged lower portions communicate with more narrow upper portions to establish a keyway so that the console 16** may be easily hung from screw or nail-like supports secured in a wall or equivalent structure.

Figure 4:
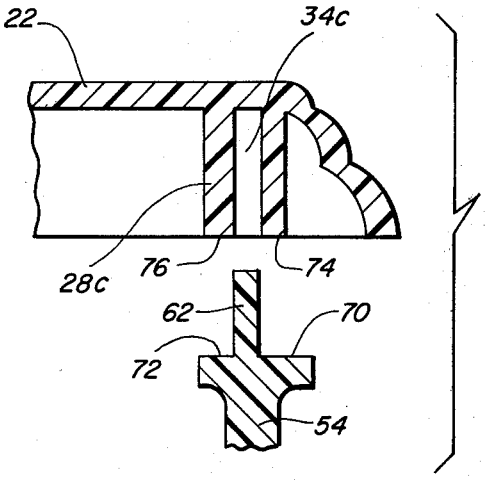
FIG. 4 is a fragmentary cross sectional view taken substantially on the lines 4—4 of FIG. 3 indicating schematically the manner in which the shelf and the skirt are interconnected by means of channel slots and cooperating flanges.
Figure 7:
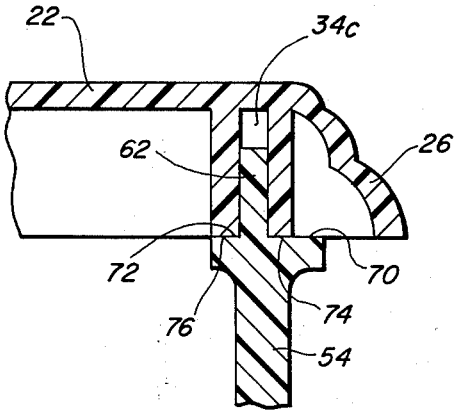
FIG. 7 is a fragmentry cross sectional view taken substantially on the lines 7—7 of FIG. 6 and showing the flange and slot intercoupling between the skirt and shelf.
Figure 8:
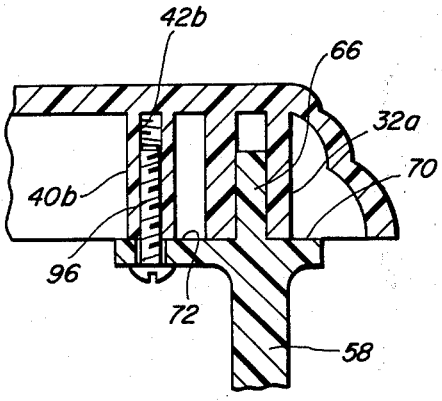
FIG. 8 is a fragmentary cross sectional view showing the post, tab and screw securement of the side skirt to the shelf.
Figure 9:
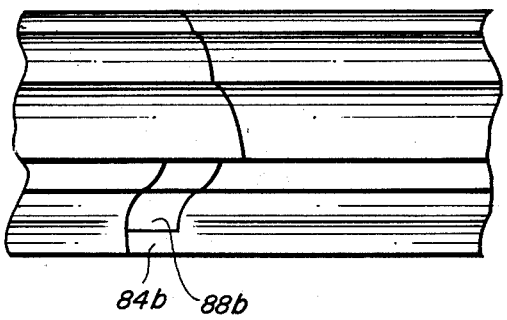
FIG. 9 is a fragmentary view of the circled portion of FIG. 1 showing the interlock of the side panel of the skirt over the center panel.
Figure 3:
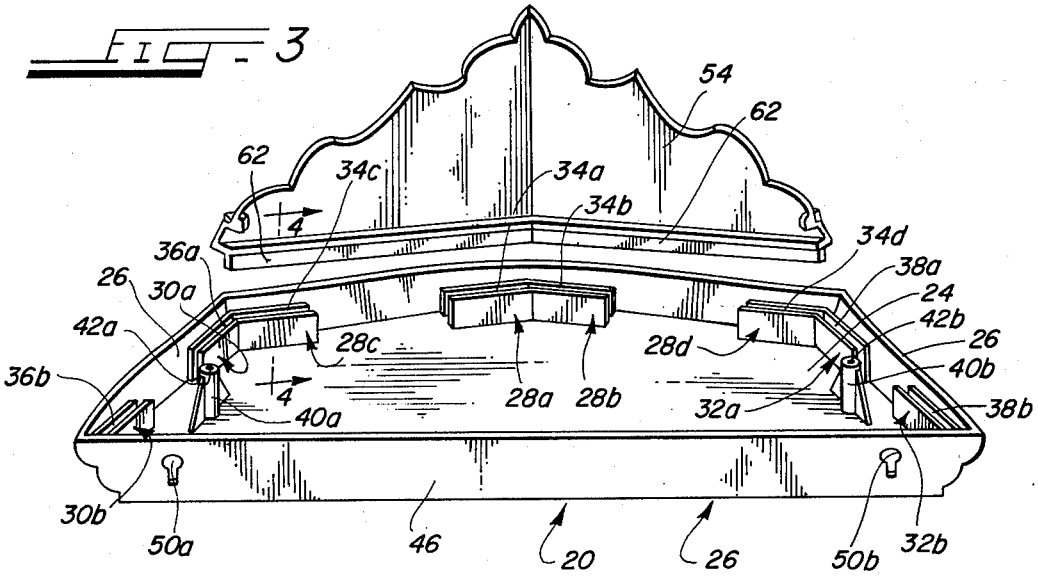
FIG. 3 is a perspective exploded view in the inverted position showing the table top or shelf with the center panel of the skirt vertically aligned for intercoupling, securing engagement with the shelf, as a first step in table assembly.
Figure 5:
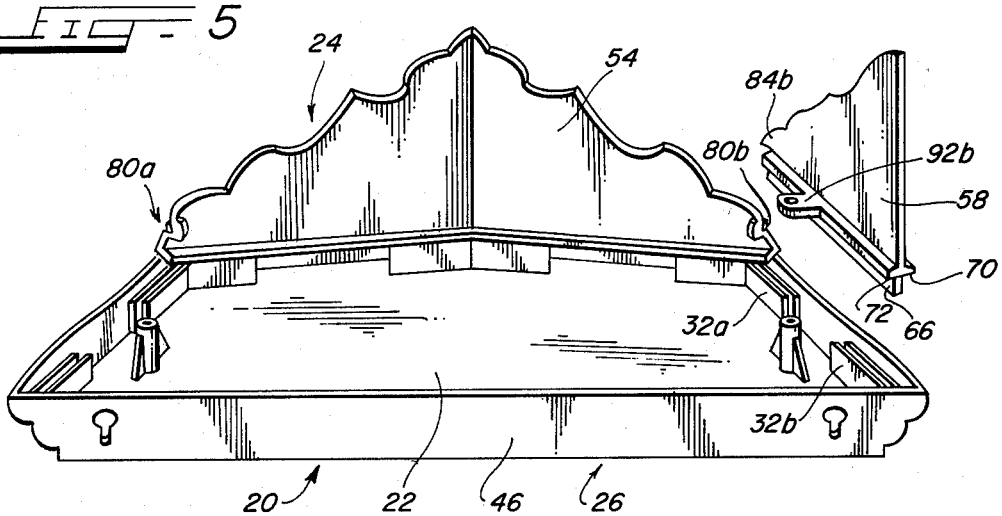
FIG. 5 is a perspective view in the inverted position, partially exploded, and showing the center skirt section attached to the shelf, and one side skirt section aligned for coupling with both the shelf and the center section of the skirt, as a second step of table assembly.
Figure 6:
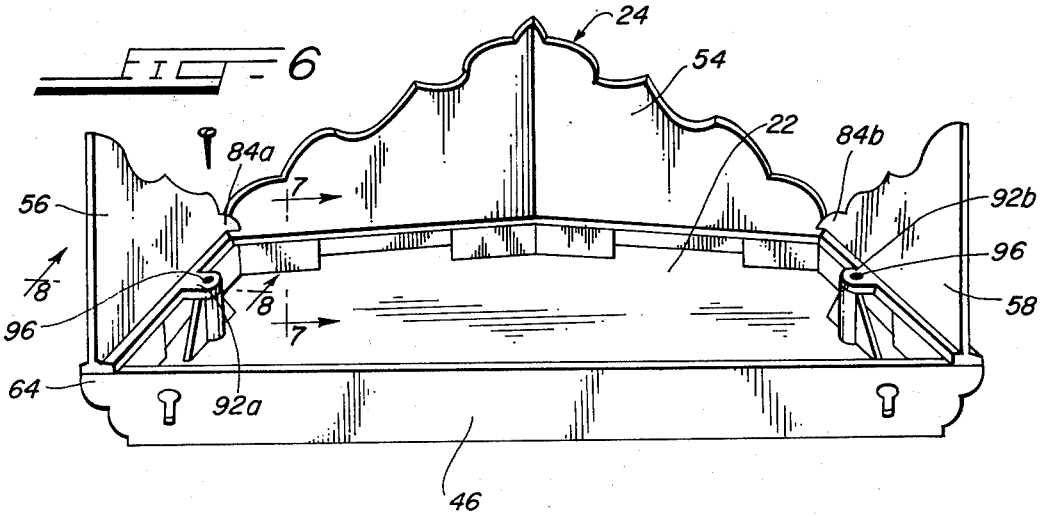
FIG. 6 is a perspective view of the assembled table with alignment of final screw as seen from the inverted position.

It is an important feature of the present invention that the depending skirt 24 is fabricated as a plurality rather than a single element. In the example shown, the skirt 24 consists of three sections including a front section 54 and a pair of bracket-like side sections 56 and 58. Each skirt section is formed with its own integral flange, flattened rib, or bead 62, 64 and 66 projecting upwardly from and linearly along the top edge of the skirt, the flanges being oriented and sized so as slidably to be received into and to seat in corresponding slots 34, 36 and 38 to establish a firm and structurally secure engagement between the skirt components 54, 56 and 58 and the table top 22. The mechanical stability of the assembly is enhanced in that with the flanges 62, 64 and 66 fully advanced into the respective slots 34, 36 and 38, shoulder webs 70 and 72 coextensive with and extending laterally along and transversely of the flanges "bottom" and seat contiguously on the end faces 74 and 76 of the wall sections 28, 30 and 32 which define the flange-receiving slots 34, 36 and 38, all as clearly shown in FIGS. 4 and 7.

That end of each side skirt or bracket 56 and 58 which is adjacent a corresponding lateral extremity 80*a* and 80*b* of the front section of the skirt 54 is cut away to form an overhang or projection 84*a*, 84*b* which overlies and bears upon a cooperating shoulder 88*a* and 88*b* of the center skirt section 54 so that the side brackets 56 and 58, when engaged within and seated in the slots 36 and 38 of the top panel 22, lock and hold the center skirt section 54 in place. In turn, the side brackets themselves are firmly and reliably secured to the table top 22 by means of wings or tabs 92*a* and 92*b* integrally formed with the brackets 56 and 58 and extending inwardly and laterally thereof so as closely to overlie the top surface of respective posts 40*a* and 40*b* projecting from the undersurface of the top panel 22. The tabs 92*a* and 92*b* are formed with through holes aligned to register with the threaded bores 42*a* and 42*b* of the posts 40*a* and 40*b* so that screws 96 extending through the tabs 92*a* and 92*b* and into the threaded posts 40*a* and 40*b* constitute positive securement means fastening both the side skirts 56 and 58, as well as the interlocked front skirt section 54 to the top panel 22 of the console table.

It will be evident from the foregoing description that the manner of assembly of the console table of the invention is most simple. Conveniently, the top panel 22 is first placed, topside down, on a supporting surface. The center or front section 54 of the skirt 24 is then positioned in place by easing the linear flange 62 into the cooperating slots 34 to effect frictional securement. Next, each side skirt section or bracket 56 and 58 is similarly forced into place with each flange 66*a* and 66*b* inserted into its respective slot 36 and 38 so that the overhang 84*a*, 84*b* of each side skirt section 56 and 58 overlies a corresponding edge or shoulder 88*a* and 88*b* of the front skirt section 54. Finally, with the tabs 92 now overlying posts 40*a* and 40*b*, screws 96 are attached so as firmly to lock the entire assembly together as a unitary structure.

In accordance with the invention a novel, simple, yet highly efficient and effective means has been provided for firmly and reliably securing a multi-component console table together as a unitary structure, without glue and without special tools. While any structural material may be used, in the specific embodiment diclosed, the various component elements of the console table are made of injection molded plastic material. The entire structure may be economically and practically fabricated, and in its disassembled form is conveniently packaged as an extremely compact, space-conserving unit.

While a disclosure of a preferred embodiment of the invention and preferred methods for fabricating the structural components of the invention have been provided, it will be apparent to those skilled in the arts that numerous modifications, changes, and variations can be made without departing from the essential spirit of the underlying principles of the invention. It is, therefore, desired by the following claims to include in the scope of the invention all such variations and modifications by which substantially the results of this invention may be obtained through the use of substantially the same or equivalent means.

What is claimed is:

1. A sectional, knocked-down console table of molded plastic components adapted for attachment to a wall and the like to hang thereon, said table comprising:

a shelf of generally tray-like construction including a substantially planar article-supporting top panel and integrally formed rail means extending perimetrically therearound and projecting downwardly therefrom, opposed, laterally spaced, generally parallel wall means integrally formed with said panel at an undersurface thereof to project downwardly therefrom to define downwardly opening channel-like slot means, a skirt adapted for securement to said top panel to depend downwardly therefrom adjacent a generally forwardly directed marginal edge thereof, said skirt including a front section and a pair of opposed side sections, each of said side sections of said skirt being formed at an upper inward extremity thereof with a cutaway corner defining a generally horizontal edge, and further comprising a cooperating shoulder integrally formed with the front section of said skirt at each opposed end thereof, said horizontal edge of said corner being adapted to overlie said shoulder thereadjacent to retain the front section of said skirt secured within said slots, fastener means for securing said front section of said skirt to said panel, said fastener means including first flange means integrally formed with said front section and projecting upwardly therefrom and along a top edge thereof, said first flange means being spacially oriented and adapted to enter into said channel-like slot means in said shelf along a forward edge thereof for seating and intercoupling engagement therewithin, attachment means for fastening said side sections of said skirt to said panel to extend downwardly therefrom at opposed lateral extremities of said front section of said skirt, said attachment means including second flange means integrally formed with each of said side sections and projecting upwardly therefrom along a top edge thereof, said second flange means being spacially oriented and physically dimensioned for engagement within a cooperating said slot means in said panel, for securement of said side sections of said skirt to said panel.

2. The structure as set forth in claim 1 and further comprising positive locking means for detachably securing said side sections of said skirt to said panel, said locking means comprising, in combination, post means integrally formed with said panel and extending generally normally thereto from an undersurface thereof, said post means being formed with a bore having internal screw threads, tab means integrally formed with said side sections and extending laterally and inwardly therefrom to overlie said post means in substantially contiguous abutment therewith, said tab means being formed with a hole extending transversely therethrough and adapted to receive therewithin a threaded screw for mechanical interengagement with the threads within said post means, to secure said side sections of said skirt to said top panel.

* * * * *